United States Patent [19]

Karabedian

[11] Patent Number: 4,657,177

[45] Date of Patent: Apr. 14, 1987

[54] CARTON FORMED FROM BLANK OF EXPANDED POLYMER MATERIAL AND BLANK THEREFOR

[75] Inventor: James A. Karabedian, Toledo, Ohio

[73] Assignee: Owens-Illinois, Inc., Toledo, Ohio

[21] Appl. No.: 796,523

[22] Filed: Nov. 12, 1985

Related U.S. Application Data

[63] Continuation of Ser. No. 638,144, Aug. 6, 1984, abandoned.

[51] Int. Cl.[4] ..... B65D 5/08

[52] U.S. Cl. ..... 229/137; 229/3.1; 229/3.5 R; 229/17 R; 229/132

[58] Field of Search ..... 229/37 R, 38, 3.5 R, 229/17 R, 132, 133, 136, 137, 138, 3.1

[56] References Cited

U.S. PATENT DOCUMENTS

| | | | |
|---|---|---|---|
| Re. 30,098 | 9/1979 | Titchenal et al. | 229/3.5 R |
| 1,723,150 | 8/1929 | Gannon et al. | 229/37 R |
| 1,987,647 | 1/1935 | Wellman | 229/37 R |
| 2,516,085 | 7/1950 | Williamson | 229/37 R |
| 2,553,803 | 5/1951 | Zinn, Jr. | 229/37 R |
| 2,729,385 | 1/1956 | Moore | 229/37 R |
| 3,389,849 | 6/1968 | Egleston | 229/17 G |
| 3,533,549 | 10/1970 | Gilchrist et al. | 229/37 R |
| 3,577,484 | 5/1971 | Jacobson | 229/3.5 R |
| 3,985,284 | 10/1976 | Palsson | 229/3.5 R |

FOREIGN PATENT DOCUMENTS

| | | | |
|---|---|---|---|
| 1514855 | 1/1968 | France | 229/37 R |
| 623494 | 7/1961 | Italy | 229/37 R |

*Primary Examiner*—William Price
*Assistant Examiner*—Gary E. Elkins
*Attorney, Agent, or Firm*—John R. Nelson

[57] ABSTRACT

A six-sided or parallelepiped carton which is formed by folding a die-cut blank of a generally rigid, unitary blank of a polymeric material in which a major portion of the thickness of the blank comprises an expanded polymeric material, at least some of the corners of such carton being self-sealed by webbed areas or gussets which comprise portions of such blank but which are of reduced thickness relative to the major portions of the remainder thereof, and a die-cut blank which is adapted to be formed into such a carton.

12 Claims, 11 Drawing Figures

CARTON FORMED FROM BLANK OF EXPANDED POLYMER MATERIAL AND BLANK THEREFOR

This is a continuation of application Ser. No. 638,144, filed Aug. 6, 1984, now abandoned.

BACKGROUND OF THE INVENTION

This invention relates generally to a six-sided carton which is formed from a generally rigid, unitary, foldable, sheet like blank of an expanded polymeric material, and more particularly to a carton of such character in which at least some of the corners are sealed by means which are a part of such blank to seal the contents of the carton and to thereby prevent the egress of the contents of the carton and the entry of oxygen and moisture from the atmosphere into the carton.

It is quite common to utilize a six-sided carton which is formed by folding a generally rigid, unitary, foldable, sheet like blank of paperboard or other fibrous material for many packaging applications, for example in the packaging of breakfast cereals and in the packaging of powdered laundry detergents. These cartons usually require separate means to help prevent the contents of the carton from escaping through the gaps or spaces which are normally formed at the corners of such cartons, and to help prevent oxygen and moisture from the atmosphere from attacking the contents of the carton. Such separate means may take the form, for example, of a separate sealed bag which, is placed in the carton and in which in turn, the packaged product is placed.

Generally rigid polymeric materials, including expanded or foamed polymeric materials, offer many advantages over paperboard as a material of construction, including attractive appearance, relatively low cost, moisture imperviousness and good strength and rigidity characteristics in relationship to thickness and weight, and for these reasons these materials have captured important segments of packaging markets which were once held by paperboard. To date, however, polymeric materials have not been able to displace paperboard or other fibrous materials as the material of construction for folding boxes or cartons for breakfast cereals and other dry or particulate products to any great extent, at least in part due to the problems which relate to the sealing of the corners of such cartons.

GENERAL DESCRIPTION OF THE INVENTION

In accordance with the present invention there is provided a six-sided carton which is formed from a generally rigid, unitary, foldable, die-cut sheetlike blank of a polymeric material at least a major portion of which comprises an expanded polymeric material, which has thickness, strength, rigidity and weight characteristics that are suitable for the packaging of many products which are now packaged in paperboard cartons, and which, because of the compressibility of such expanded polymeric materials, can be provided with integral means to seal the corners of such cartons, thereby eliminating the need for an inner bag or other separate means for accomplishing the sealing of the corners. Such sealing function is accomplished by providing webbed areas or gussets in at least some of the end flap portions of the blanks adjacent the scored lines therein which define the lines along which the blank is folded to form the carton, and by compressing these webbed areas or gussets to permit them to be folded into relatively thin sealing means lying between the folded over end flaps which define one or both of a pair of the sides of the carton, usually the top and bottom, at the corners of such sides.

Accordingly, objects of the present invention are to provide an improved carton which is formed from a generally rigid, foldable blank of a sheetlike material and a blank from which such a carton can be formed. More particularly, objects of the present invention are to provide a carton which is formed from a generally rigid foldable blank of a sheetlike polymeric material at least a major portion of which comprises an expanded polymeric material and a blank of a polymeric material at least a major portion of which comprises an expanded polymeric material from which such a carton can be formed. Even more particularly, objects of the present invention are to provide an improved six-sided carton which is formed from a generally rigid, foldable blank of a sheetlike polymeric material at least a major portion of which comprises an expanded polymer material and which has at least some of the corners of such carton sealed by means which comprise an integral portion of such blank, and a blank from which such a carton can be formed.

For a further description of the present invention and the objects thereof, attention is directed to the drawing and the following description thereof, to the detailed description of the invention and to the appended claims.

DETAILED DESCRIPTION OF THE INVENTION

Figure 1:
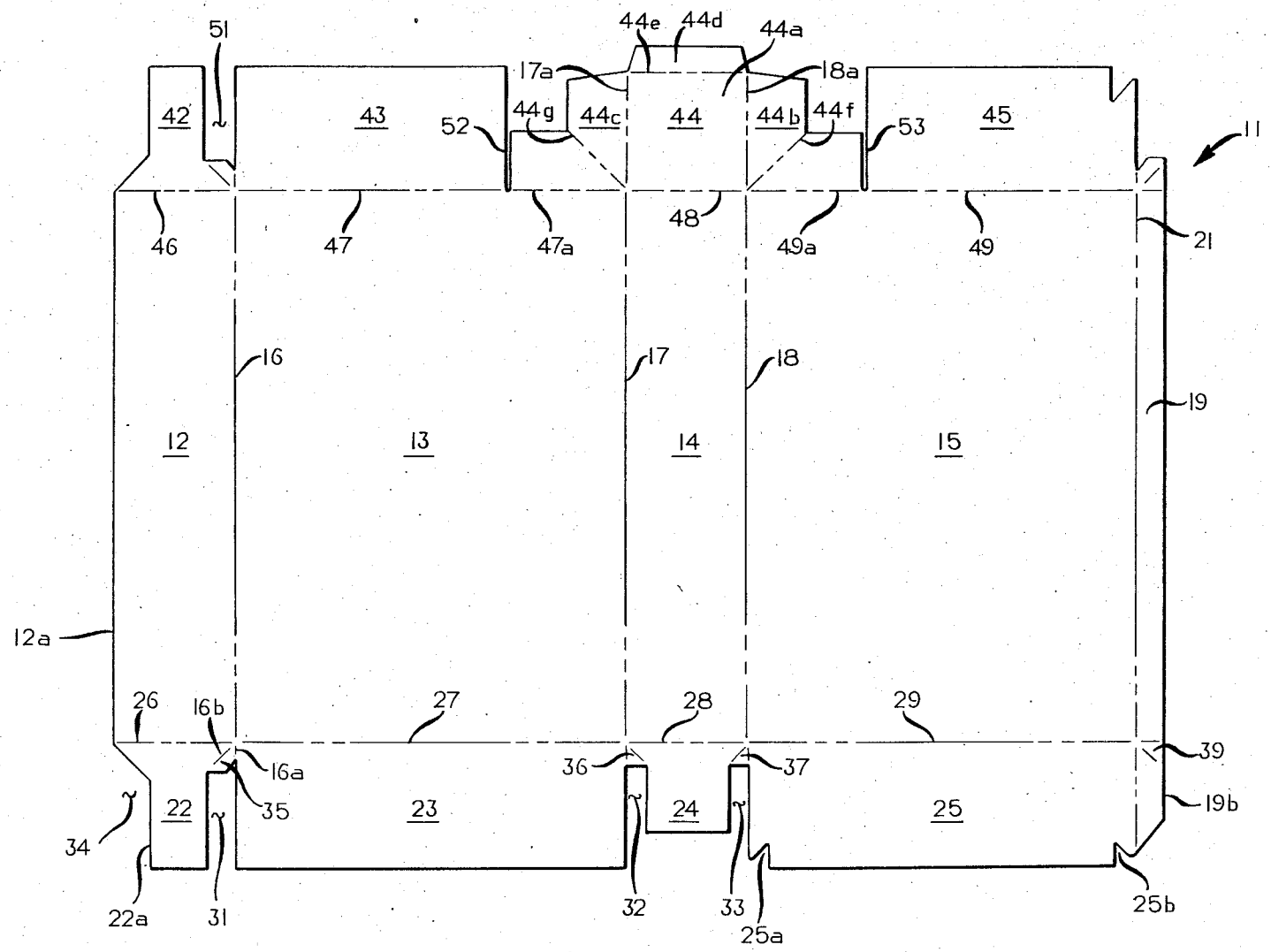
FIG. 1 is a plan view of a preferred embodiment of a blank in accordance with my invention.
Figure 2:
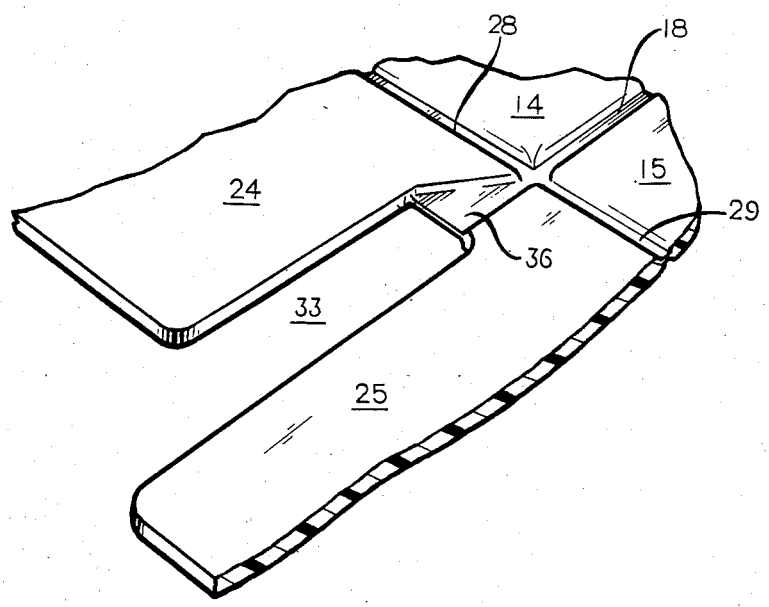
FIG. 2 is an enlarged fragmentary schematic view showing a portion of the blank of FIG. 1.

As is shown in FIG. 1, there is provided a die-cut blank, generally indicated by reference numeral 11, from which a parallelepiped or six-sided carton may be formed. In the case of a blank for a carton for the packaging of a breakfast cereal, blank 11 may be advantageously formed from expanded general purpose or impact polystyrene in a thickness of the order of 36–40 mils (0.036–0.040 in.) and of a density of the order of 6–8 pounds per cubic foot. Preferably blank 11 is also provided with thin layers of a non-expanded polymeric material such as polyethylene on the opposed surfaces thereof for improved resistance to moisture vapor transmission. These surfaces layers, for example 1.5 mils in thickness on the outside surface and 0.5 mils in thickness on the inside surface, can be formed on a core of expanded polystyrene by co-extrusion, extrusion coating a lamination in a known manner, and preferably involve the use of a suitable agent to effect bonding of these dissimilar materials, such as ethylene vinyl acetate, which can be utilized between the layers or in one both of the adjoining layers. In any case, blank comprises serially connected rectangularly-shaped panels 12, 13, 14 and 15 which are integrally connected to one another and which are formed by scoring blank 11 along fold lines 16, 17 and 18. Also formed in blank 11 is a flap 19 which is integrally connected to panel 15 along fold line 21, which may also be formed by scoring.

Figure 3:
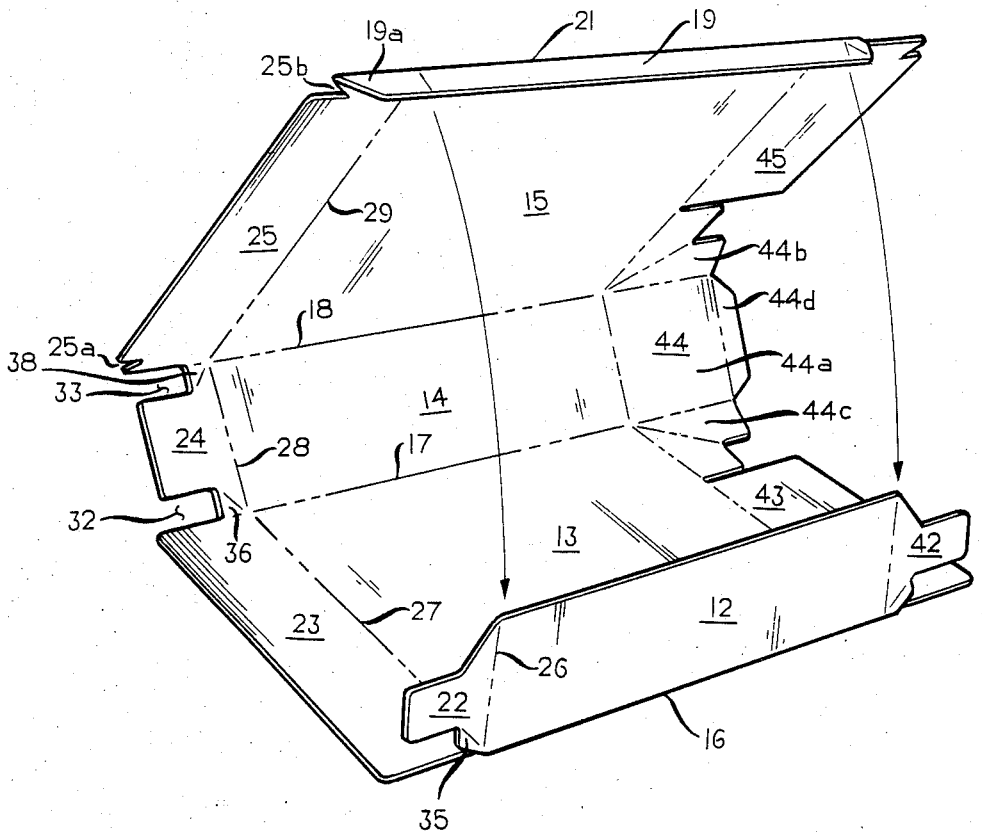
FIG. 3 is a schematic view showing the blank of FIG. 1 in a preliminary stage of the forming of a carton therefrom.
Figure 4:
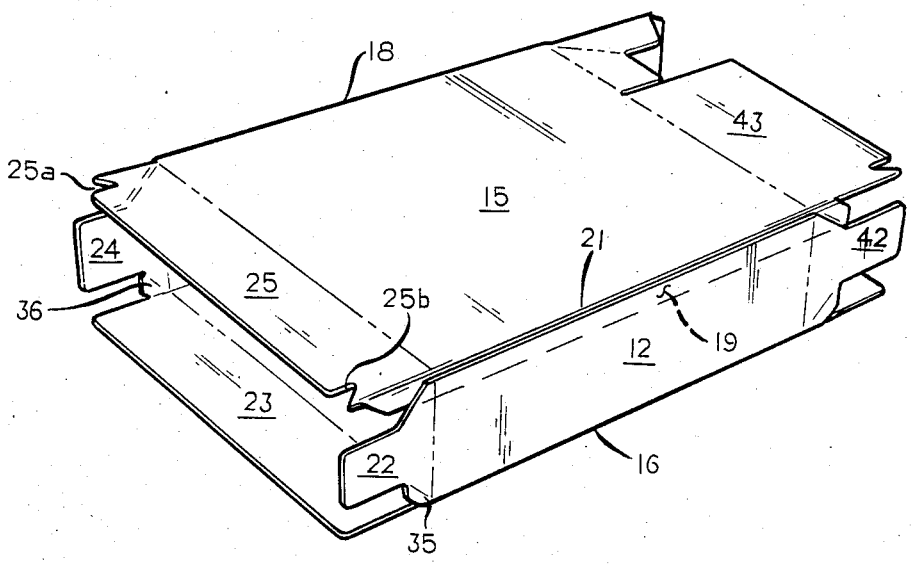
FIG. 4 is a schematic view showing a partially formed carton which has been formed from the blank of FIG. 1.

As is depicted in FIGS. 3 and 4, the forming of a carton from blank 11 involves folding the blank along fold lines 16, 17, 18 and 21 into a tubular configuration, to bring panel 12 into a position overlying flap 19 to form the side seam of the carton. Panel 12 and flap 19 are joined to one another in this tubular configuration by heat sealing or by the use of an adhesive, or by other known means for forming a joint in a carton.

The portion of the carton which normally comprises the bottom of the carton when it is in an upright position is formed by a series of flaps 22, 23, 24 and 25 which are integrally attached to panels 12, 13, 14 and 15, respectively, along fold lines 26, 27, 28 and 29. Flaps 22, 23, 24 and 25 are separated from one another by slots 31, 32 and 33 which, to form the corner sealing means in the corners of the bottom structure of the carton, extend only partially to the fold line comprising fold lines 26, 27, 28 and 29. For the same reason, the outermost marginal portion of the edge 22*a* of flap 22 is inwardly offset from the edge 12*a* of blank 11. Slot 31 helps to define, with an extension 16*a* of fold line 16 and a fold line 16*b* extending from the juncture of fold lines 27 and 16 outwardly to tab 22, a generally triangularly shaped gusset portion 35 in blank 11. This gusset is compressed to substantially less than its original thickness in the die-cutting operation which is utilized to form blank 11, for example, to about the thickness of the scored fold lines or about no more than one half the original thickness of blank 11. Similar triangularly shaped compressed gusset areas 36 and 37 are formed between the ends of slots 32 and 33, respectively, and another triangularly-shaped compressed gusset area 39 is formed in the extension 19*a* which extends beyond score line 29, almost to the end of flap 25.

Figure 5:
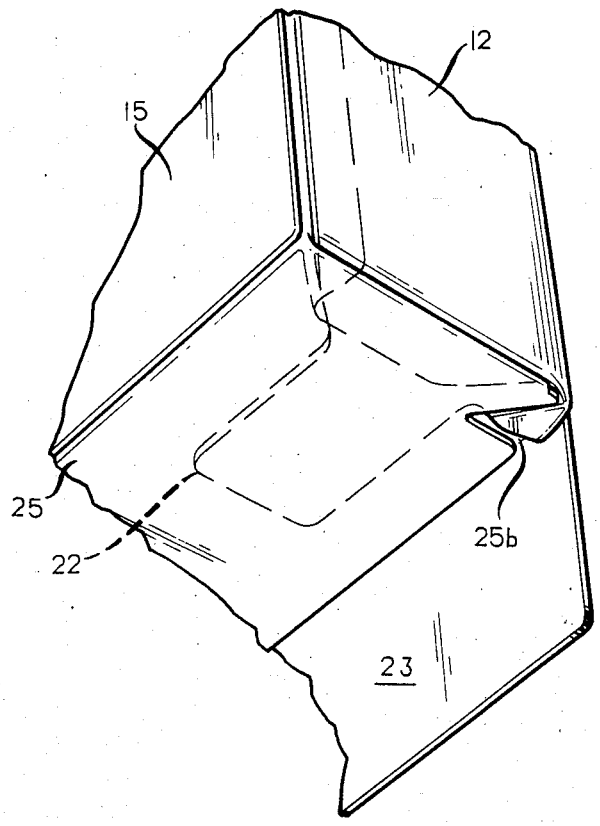
FIG. 5 is an enlarged fragmentary schematic view showing a portion of a carton as it is being formed from the blank of FIG. 1.

As is partially shown in FIG. 5, the end structure for the carton to be formed from blank 11 is formed by folding end tabs 22 and 24 to extend inwardly from panels 12 and 14 and generally at right angles thereto. One of the remaining flaps, shown as flap 25, is then inwardly folded to overlie flaps 22 and 24, and the remaining flap, shown as flap 23, is then inwardly folded to overlie flap 25. The innermost of flaps 23 and 25, shown as flap 25, may be advantageously provided with triangularly-shaped notched areas 25*a* and 25*b* in its outer corners to engage one of the pair of gusset areas, shown as gusset areas 35 and 36, to help rigidify the corner areas of the bottom of the carton. In any case, gusset areas 35 and 39 are brought into positions overlying flap 22, and gusset areas 36 and 37 are brought into position overlying flap 24, to effectively seal the corners formed at the bottom of the carton. The superimposed flaps may then be joined to one another, as by heat-sealing, to permanently secure the bottom structure of the carton.

While the top structure of the carton formed from blank 11 may be identical to the heretofore described bottom structure, in my preferred embodiment it is provided at one end thereof with a reclosable pour-out spout in accordance with the invention covered in the application of James B. Foote which is being filed contemporaneously herewith, Ser. No. 638 145. Thus, the end away from the reclosable pour-out spout is formed by flap 42 which is attached to panel 12 along fold line 46 similar to the attachment of flap 22 along fold line 26, and by partial flaps 43 and 45 which are attached to panels 13 and 15 along fold lines 47 and 49, respectively, flap 43 being separated from flap 42 by partial depth slot 51 (which is similar to slot 31). The pour-out feature is provided by irregularly shaped flap 44 which is attached partially to panel 14 along fold line 48 and partially to panels 13 and 15 along inwardly extending portions 47*a* and 49*a* of fold lines 47 and 49, respectively. Flap 44 is comprised of a rectangularly shaped central portion 44*a* and generally L-shaped portions 44*b* and 44*c* which extend outwardly from opposite sides of central portion 44*a* and which are foldable relative to the central portion 44*a* along fold lines 18*a* and 17*a* respectively. Fold lines 18*a* and 17*a*, in turn, respectively comprise extensions of fold lines 18 and 17. Flap 44 also comprises an outwardly extending marginal tab portion 44*d* which is attached to central portion 44*a* along fold line 44*e*. Additionally, the legs of L-shaped portions 44*b* and 44*c* are separated from one another along fold lines 44*f* and 44*g*, respectively, and the edges of flap 44 are separated from flaps 43 and 45 by narrow slots 52 and 53 respectively.

Figure 6:
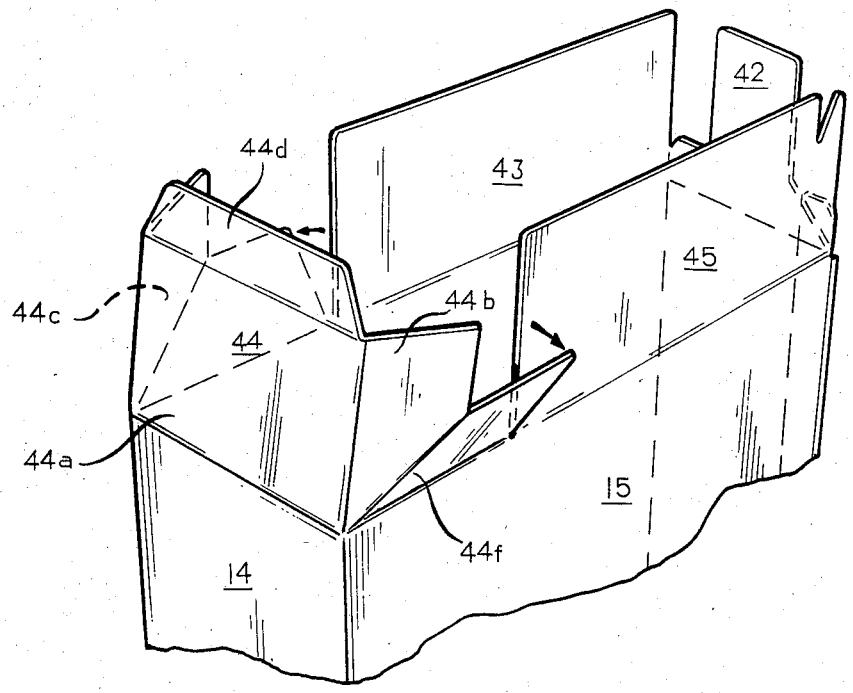
FIG. 6 is an enlarged fragmentary schematic view of a portion of a carton as it is being formed from the blank of FIG. 1.
Figure 7:
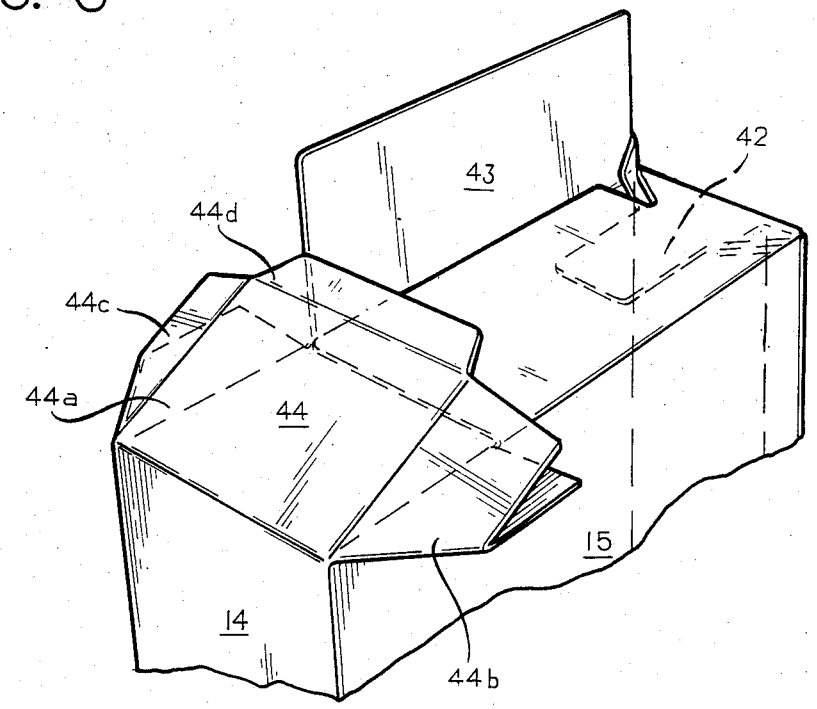
FIG. 7 is an enlarged fragmentary schematic view of the portion of the carton which is depicted in FIG. 6 at a subsequent stage of its formation.
Figure 8:
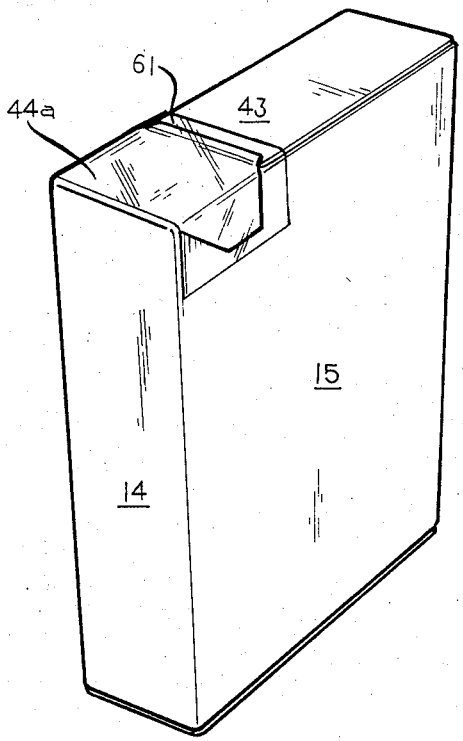
FIG. 8 is a schematic view of the assembled carton which has been formed from the blank of FIG. 1.
Figure 9:
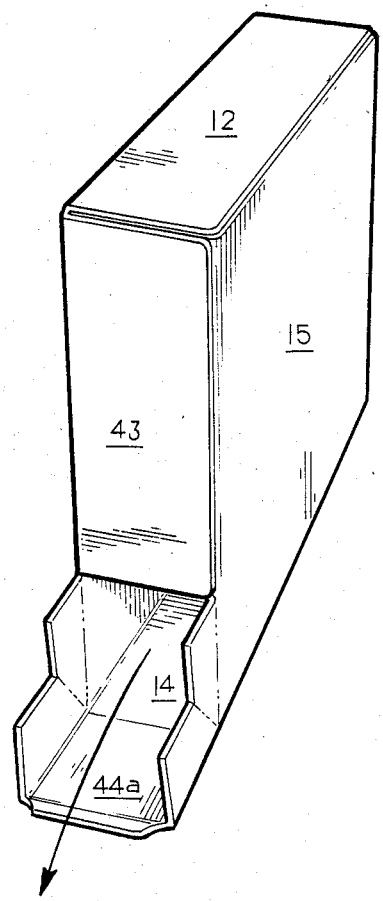
FIG. 9 is a schematic view showing the pour-out spout feature of the carton which has been formed from the blank of FIG. 1.
Figure 10:
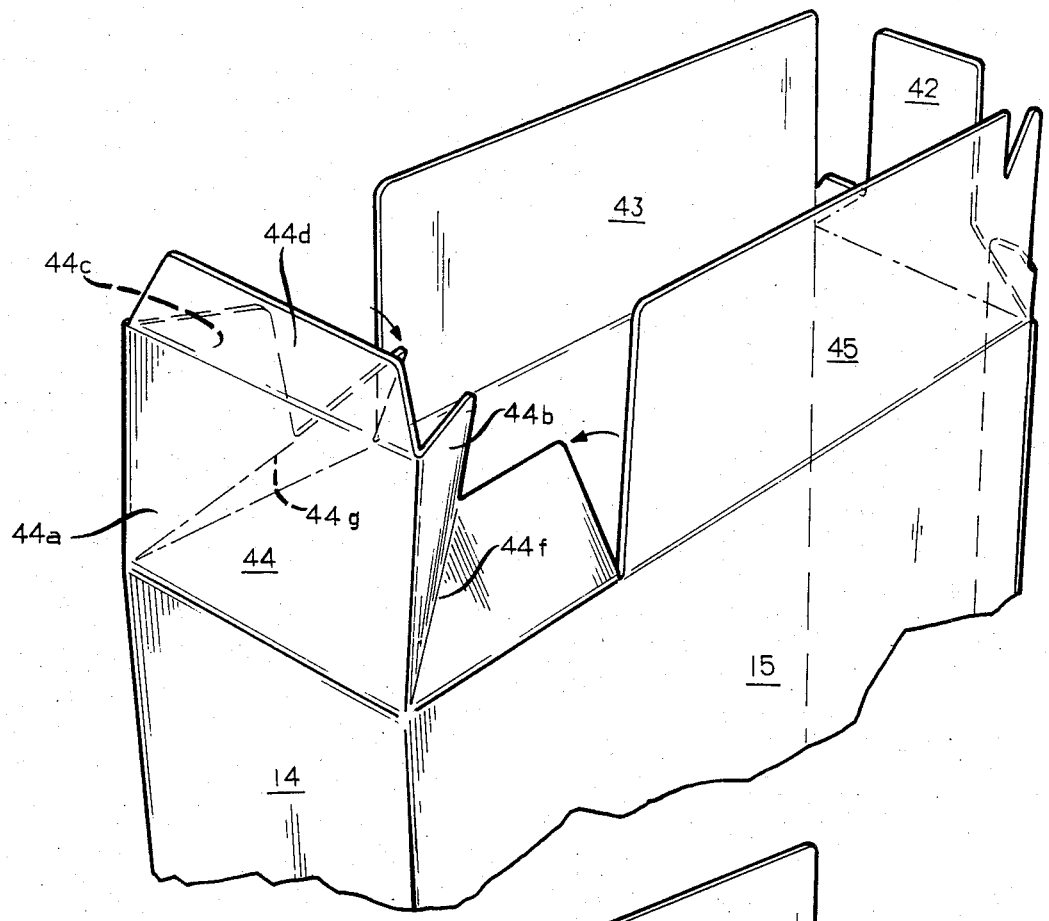
FIG. 10 is an enlarged fragmentary schematic view of a portion of a carton as it is being formed in an alternative manner from the blank of FIG. 1.
Figure 11:
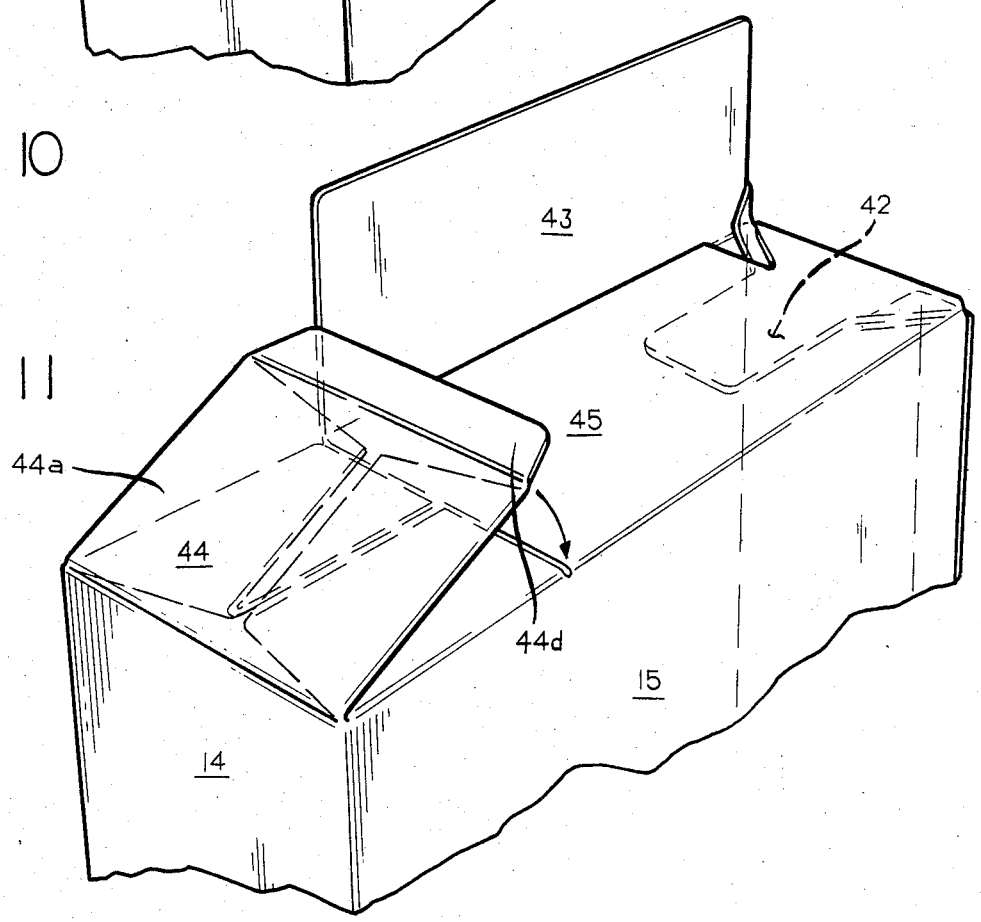
FIG. 11 is an enlarged fragmentary schematic view of the carton which is depicted in FIG. 10 at a subsequent stage of its formation.

In the assembly of the top structure of the carton, after the tubular structure of FIG. 4 has been formed, L-shaped portions 44*b* and 44*c* of flap 44 are folded outwardly along lines 44*f* and 44*g*, respectively, as is shown in FIGS. 6 and 7, to bring the now-folded L-shaped portions 44*b* and 44*c* into positions extending outwardly from central portion 44*a*. As is shown in FIG. 8, the outwardly projecting folded L-shaped portions are then folded downwardly to overlie carton sides 15 and 13, respectively, and they are secured in these positions until the first opening of the carton by means of a short length of removable pressure sensitive tape 61. The package is shown in a partially inverted position in FIG. 9 and in an opened position with the structure formed from flap 44 constituting a pour-out spout, and the package can be reclosed, as is desirable when only a portion of the contents is withdrawn, by reclosing the pour-out spout into the configuration depicted in FIG. 8, and the reclosed carton can be secured in such position without the need for reapplying tape 61, or a replacement therefor, by bending tab portion 44*d* or flap 44 downwardly to insert it in the slot defined by slots 52 and 53 of blank 11.

The best mode known to me to carry out this invention has been described above in terms sufficiently full, clear, concise and exact as to enable any person skilled in the art to make and use the same. It is to be understood, however, that it is within my contemplation that certain modifications of the above-described mode of practicing the invention can be made by a skilled artisan without departing from the scope of the invention and it is, therefore, desired to limit the invention only in accordance with appended the claims.

What is claimed is:

1. A six-sided carton formed from a unitary blank of a sheetlike, generally rigid polymeric material by die-cutting, a major portion of the thickness of said generally rigid polymeric material comprising an expanded polymeric material, said generally rigid polymeric material further comprising at least one thin layer of a non-expanded polymeric material on one of the opposed surfaces of said blank for improved resistance to moisture vapor transmission, said carton being sealed against moisture vapor transmission and comprising, in combination:

four sides formed in an open-ended tubular configuration from four serially connected panels in said blank by bending along fold lines at the junctures between said panels, the first and fourth of said panels being joined to one another in a joint;

a self-sealing end structure formed at one end of said tubular configuration, said self-sealing end structure sealing said one end against moisture vapor transmission and comprising four flaps and being formed by the inward folding of each of said four flaps, each of said four flaps comprising an integrally formed portion of said blank and depending from and being foldable with respect to one of said panels alone a fold line at the juncture between said each of said four flaps and said one of said panels, said four flaps being separated from one another by slots, each of said slots extending from the marginal edge of said blank adjacent said four flaps only partially to the fold lines between said panels and said flaps, the outer marginal edge of one of said four flaps of said self-sealing end structure comprising first and second spaced apart notched areas;

a plurality of gusset areas, each of said gusset areas lying between an adjacent pair of said flaps when said self-sealing end structure is formed by the inward folding of each of said four flaps to seal the corner of said carton that is adjacent said adjacent pair of said flaps, each of said gusset areas being compressed in the die-cutting step to a thickness of no more than about one-half of the thickness of said blank to reduce the thickness of the corners of said self-sealing end structure, each of said first and second spaced apart notched areas of said outer marginal edge of said one of said four flaps of said self-sealing end structure being aligned with and engaging one of said plurality of gusset areas when said four flaps are inwardly folded to rigidify said self-sealing end structure; and means for sealingly closing the other end of said open-ended tubular configuration against moisture vapor transmission.

2. A carton according to claim 1 wherein said carton is adapted to contain a particulate material in direct contact with the interior of said carton.

3. A carton according to claim 1 wherein said generally rigid polymeric material further comprises a second thin layer of a non-expanded polymeric material, said second thin layer of a non-expanded material being on the other of said opposed surfaces of said blank.

4. A carton according to claim 1 wherein said expanded polymeric material comprises expanded polystyrene and wherein said non-expanded polymeric material comprises polyethylene and wherein said blank further comprises a bonding agent for bonding said expanded polymeric-material and said non-expanded polymeric material to one another.

5. A carton according to claim 4 wherein said bonding agent comprises ethylene vinyl acetate.

6. A sheetlike, generally rigid, unitary die-cut blank of a polymeric material which is adapted to be formed into a six-sided carton which is sealed against moisture vapor transmission, a major portion of the thickness of said polymeric material comprising an expanded polymeric material, said polymeric material further comprising at least one thin layer of a non-expanded polymeric material on one of the opposed surfaces of said blank for improved resistance to moisture vapor transmission, said blank comprising, in combination:

four serially connected and generally rectangularly-shaped panels foldably separated from one another along scored fold line means extending between adjacent panels of said four serially connected and generally rectangularly-shaped panels;

four flaps, each of said four flaps respectively depending from an edge of one of said four serially connected and generally rectangularly-shaped panels, each of said flaps being separated from the panel from which it depends by a scored fold line, each pair of adjacent flaps of said four flaps being partially separated from one another by a slot that extends from the marginal edges of said pair of adjacent flaps only partially to the respective scored fold lines that separate each flap in said pair of adjacent flaps from the respective one of said four serially connected and generally rectangularly-shaped panels from which said flap depends, said slot defining, with at least one of said respective fold lines, a gusset area which is adapted to seal the corner of the bottom structure that is formed from said pair of adjacent flaps and the respective pair of said four panels from which said pair of adjacent flaps depend when said blank is folded into a carton, said gusset area being compressed in the die-cutting step to a thickness of no more than about one-half of said thickness of said polymeric material, the outer marginal edge of one of said four flaps comprising a pair of spaced apart notches, each of said pair of spaced apart notches being adapted to engage a gusset area when said blank is folded into a carton to help rigidify said bottom structure of said carton; and means extending from the opposite edges of said four panels and adapted to form a top structure of the carton when said blank is folded into a carton, said top structure being sealed against moisture vapor transmission.

7. A blank according to claim 6 wherein said polymeric material further comprises a second thin layer of a non-expanded polymeric material, said second thin layer of a non-expanded polymeric material being on the other of said opposed surfaces of said blank.

8. A blank according to claim 6 wherein said expanded polymeric materials comprises expanded polystyrene and wherein said non-expanded polymeric material comprises polyethylene, and wherein said blank further comprises a bonding agent for bonding said expanded polymeric material and said non-expanded polymeric material to one another.

9. A blank according to claim 8 wherein said bonding agent comprises ethylene vinyl acetate.

10. A blank according to claim 6 wherein said polymeric material further comprises a second thin layer of a non-expanded polymeric material, said second thin layer of a non-expanded polymeric material being on the other of said opposed surfaces of said blank.

11. A blank according to claim 6 wherein said expanded polymeric material comprises expanded polystyrene and wherein said non-expanded polymeric material comprises polyethylene, and wherein said blank further comprises a bonding agent for bonding said expanded polymeric material and said non-expanded polymeric material to one another.

12. A blank according to claim 11 wherein said bonding agent comprises ethylene vinyl acetate.

* * * * *